United States Patent [19]

Hinchcliffe et al.

[11] 4,316,754

[45] Feb. 23, 1982

[54] HANDLING ROD-LIKE ARTICLES

[75] Inventors: Dennis Hinchcliffe; Frank Heybourn, both of London; Eric A. Luddington, Ringwood, all of England

[73] Assignee: Molins Limited, London, England

[21] Appl. No.: 90,433

[22] Filed: Nov. 1, 1979

[30] Foreign Application Priority Data

Nov. 1, 1978 [GB] United Kingdom ..... 42711/78

[51] Int. Cl.[3] ..... B65G 1/00

[52] U.S. Cl. ..... 198/347; 53/148; 198/580

[58] Field of Search ..... 198/347, 580; 414/407, 414/413, 414; 33/148, 236

[56] References Cited

U.S. PATENT DOCUMENTS

| | | | |
|---|---|---|---|
| 1,921,577 | 8/1933 | Nelson | 198/580 X |
| 3,817,369 | 6/1974 | Bluthardt et al. | 198/347 |
| 4,078,648 | 3/1978 | Hinchcliffe et al. | 198/347 |

FOREIGN PATENT DOCUMENTS

| | | | |
|---|---|---|---|
| 1066118 | 9/1959 | Fed. Rep. of Germany | 53/236 |

*Primary Examiner*—Robert B. Reeves
*Assistant Examiner*—Douglas D. Watts
*Attorney, Agent, or Firm*—Craig and Antonelli

[57] ABSTRACT

A buffer reservoir system includes trolleys having vertical compartments for receiving and storing rod-like articles such as cigarettes in stack formation. A stationary conveyor system is arranged with spaced outlets and inlets so that compartments can be in simultaneous registration for loading or unloading at a common station. The outlets are closable by a rolling closure device. The station also includes means for indexing the trolley, for lowering or raising the stack in each compartment on platforms, and for removing and replacing slats at the lower ends of the compartments. A modified arrangement is disclosed having spaced loading and unloading stations so that trolleys can constitute a delay line for articles conveyed by the system.

23 Claims, 10 Drawing Figures

HANDLING ROD-LIKE ARTICLES

This invention is concerned with apparatus for handling rod-like articles such as cigarettes or cigarette filter rods. More particularly the invention relates to conveyor systems for such articles, including a reservoir for the articles.

It is often desirable to provide temporary storage facilities for rod-like articles. For example, in the transport of cigarettes from a cigarette making machine to a cigarette packing machine a buffer store may be provided so that if either of the machines is stopped the other may continue in operation for some time. Where several machine complexes are in operation it may be that in one complex the making machines consistently produce more than their associated packers can accept whereas in another complex the makers cannot keep the packers fully occupied. In such circumstances it can be useful to accept cigarettes from the one complex and transfer them to the other complex. British Patent Specification Nos. 1,404,141, and 1,404,142, and South African Patent Specification No. 76/4269 describe suitable systems in which the rod-like articles are stored and moved in trays.

U.S. Patent Application Ser. No. 786,493 now U.S. Pat. No. 4,201,507 discloses systems incorporating reversible mobile reservoirs which can be used to replace the afore-mentioned tray systems. This specification describes mobile reservoirs including conveyor means adapted to receive rod-like articles as a stack moving in a direction transverse to the lengths of the articles and for storing the articles. The rod-like articles can be supplied and stored as a continuous stream or in batches. A reservoir may be adapted for connection to a static conveyor system so that direct transfer to or from the conveyor system is possible and, in addition, so that drive for the conveyor means may be derived from a static motor unit associated with the system. The reservoir may be mounted on wheels and could be moved on a track system. Guide means may be provided for directing the reservoir into position for connection to a static conveyor system.

The present invention is particularly concerned with another form of mobile reservoir which can be used in ways similar to those disclosed with reference to the mobile reservoirs of said application, U.S. Ser. No. 786,493. Accordingly, the invention provides a conveyor system for rod-like articles including first and second conveyor means for moving said articles in stack formation in a direction transverse to their lengths at least one outlet for delivering articles from said first conveyor means, at least one inlet for delivering articles to said second conveyor means, said outlet and inlet being spaced apart, movable reservoir means having a plurality of compartments, each compartment having an entrance and an exit for articles, and means defining a path for said reservoir means whereby the reservoir may be positioned on said path with an entrance of a compartment and an exit of a compartment simultaneously in position for transfer of articles from said first conveyor means or to said second conveyor means respectively.

Each compartment is preferably arranged to receive a batch of articles in stack formation and may conveniently receive a stack directly from said outlet and eventually return the stack directly to said conveyor means through the inlet. In a preferred arrangement the compartments comprise substantially vertical channels. Conveniently the width of each channel may correspond to the width of said outlet and inlet. The reservoir means preferably comprises a trolley or other conveyance but could comprise endless conveyor means provided with partitions defining the compartments.

When the compartments comprise substantially vertical channels they preferably each have an entrance at their upper ends and an exit at their lower ends. The exit is normally closed by removable closure means. The compartments may therefore be loaded directly by passing beneath an outlet. Closure means is associated with this outlet to block it when not in use. This closure means may be a rolling band closure as disclosed in U.S. Patent Application Ser. No. 973,704, to which reference is directed in its entirety. Similarly, the compartment may be unloaded by removing the closure member associated with the exit and allowing the articles to pass downwards into an inlet.

The outlet and inlet of the conveyor means are respectively associated with a loading and unloading station. The inlet and outlet may be adjacent and may each be associated with a combined loading/unloading station. For example the inlet could be positioned directly below the outlet so that a vertical compartment can be in simultaneous registration with the outlet and inlet.

The loading station (which may be combined with the unloading station as referred to in the previous paragraph) preferably includes means for allowing progressive loading of each compartment. In the preferred arrangement, where the compartments are vertical channels, this may take the form of a platform which may be inserted into the compartment and progressively lowered through it during loading. The unloading station preferably includes means for withdrawing the closure means associated with the exit of each compartment (and for reinserting it after the compartment has unloaded into the inlet).

The conveyor system preferably includes drive means for the reservoir means, which may be in the form of an indexing mechanism for moving the reservoir means to position successive compartments at the loading and/or unloading station.

Each reservoir means could be provided with two or more parallel sets of compartments for simultaneous loading and/or unloading. The conveyor means may then be provided with appropriately spaced outlets and inlets for delivering to and receiving from the compartments. A combined inlet could receive the output from the exits of compartments in different sets.

The outlet and inlet may each be connected to parts of the conveyor means which branch from a main conveyor path in a system linking one or more article producing machines to one or more article packing machines, so that articles may be loaded into reservoir means of the system or unloaded from reservoir means as required by conditions in said main path. In such case it is convenient to arrange the path of the reservoir means to pass between the outlet and inlet so that a compartment of the reservoir means may be in simultaneous registration with the outlet and inlet. In an alternative conveyor system the outlet and inlet may be at ends of a discontinuity in part of said conveyor means and may be spaced in relation to the path of the reservoir means. Accordingly all articles in the system pass into a compartment from the outlet, are conveyed whilst in the compartment along the path of the reservoir means, and are subsequently returned to the conveyor means through the inlet. This arrangement can be useful to provide an extended length of time spent by each article passing along the conveyor means.

The invention will be further described, by way of example only, with reference to the accompanying diagrammatic drawings, in which.

Figure 1:
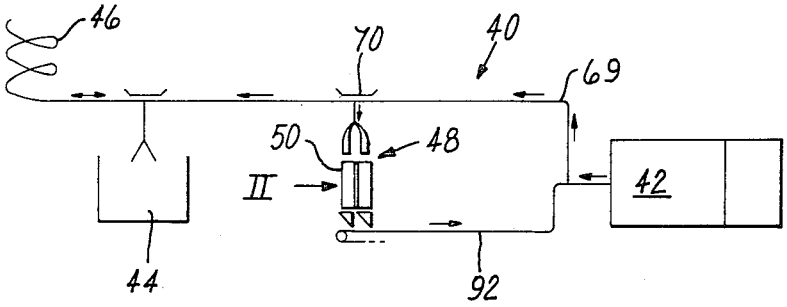
FIG. 1 shows a conveyor system for rod-like articles.

FIG. 1 shows conveyor system 40 for linking a machine 42 for producing rod-like articles to a machine 44 for packing the articles. The system 40 includes a reversible reservoir 46 such as Molins OSCAR or MOLAR, to act as a buffer for relatively short-term differences between supply of the producing machine 42 and demand of the packing machine 44. Also forming part of the system 40 is a combined loading and unloading station 48 for trolleys 50.

Figure 2:
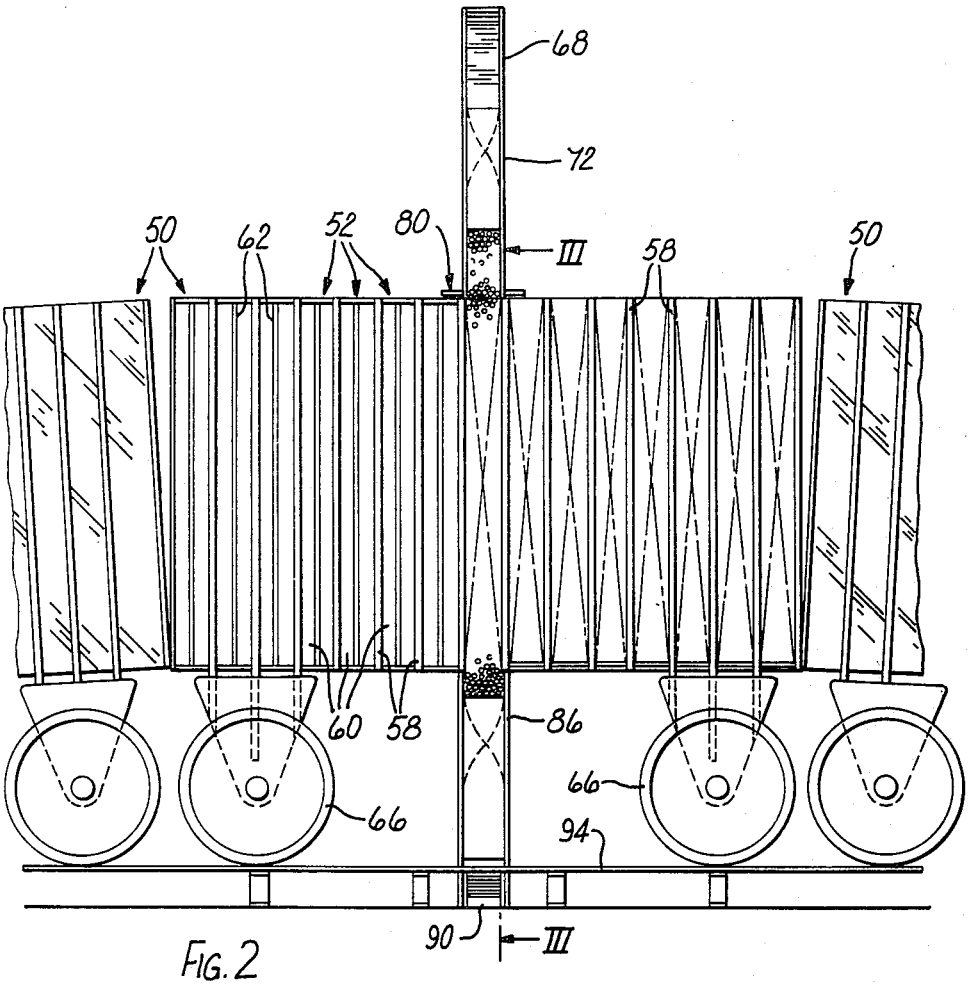
FIG. 2 is an enlarged, part-sectional view of part of the conveyor system of FIG. 1 lookding in the direction of arrow II in FIG. 1.
Figure 3:
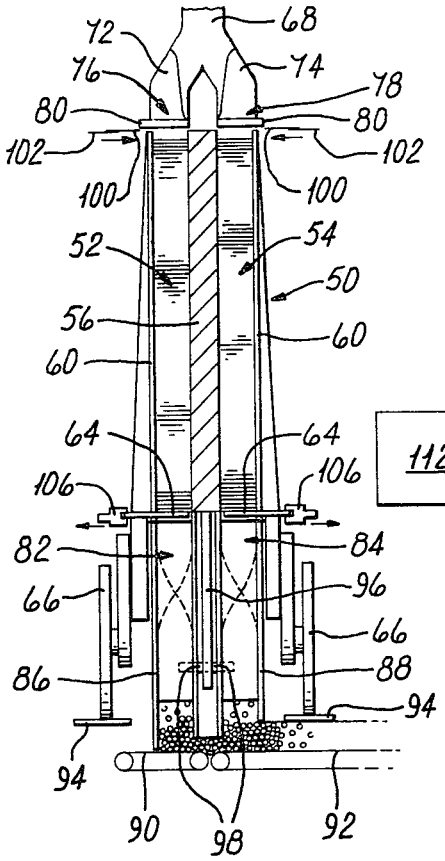
FIG. 3 is a sectional view on the line III—III in FIG. 2.

Referring now also to FIGS. 2 and 3, each trolley 50 consists of two rows of fifteen vertical channels 52, 54 arranged alongside one another on opposite sides of a central plate 56. The channels 52, 54 are respectively separated by partitions 58 which are connected to the plate 56. The sides of the channels 52, 54 opposite the plate 56 are partially closed by pairs of transparent panels 60 separated by a central vertical slot 62. At the bottom of each channel 52, 54 is a removable slat 64. The channels 52, 54 are dimensioned so that they may contain and closely confine a vertical stack of rod-like articles. The trolley 50 is supported on wheels 66.

The loading and unloading station 48 includes a chute 68 which branches from the main path 69 of the conveyor system 40 under a sensor 70. The chute 68 divides into two further chutes 72, 74 which respectively twist through 90° in opposite directions as they descend. The outlets 76, 78 of the respective chutes 72, 74 are spaced by the same distance as the rows of channels 52, 54 of a trolley 50. Associated with each outlet 76, 78 is a rolling band closure 80, which comprises at least one band passing around a movable pulley which may be projected across the respective outlet so that the band blocks the path of articles through the outlet. A full disclosure of a closure of this type is contained in said U.S. Patent Application Ser. No. 973,704, to which reference is directed.

The station 48 further includes spaced inlets 82, 84 located directly below the outlets 76, 78, which inlets lead respectively into chutes 86, 88 which twist through 90° in opposite directions and lead onto stack conveyors 90, 92. As indicated in FIG. 1 the conveyor 92 leads back to the main path 69 of the conveyor system 40.

The outlets 76, 78 and inlets 82, 84 are spaced to allow a trolley 50 to be passed between them so that a channel 52 may extend from the outlet 76 to the inlet 82 and a channel 54 may extend from the outlet 78 to the inlet 84. In this position the trolley wheels 66 are supported on a raised floor level 94, and a guide rail 96 connected to the central plate 56 passes between stationary guide rollers 98.

The trolley 50 operates as a removable reservoir for rod-like articles in the conveyor system 40. When differences between supply from the producing machine 42 and demand from the packing machine 44 are such that the reservoir 46 cannot cope the loading and unloading station 48 for trolleys 50 may be brought into operation. If supply exceeds demand articles may be loaded into trolleys 50 by diverting part or all of the flow of articles on the main path 69 into the chute 68. If demand exceeds supply then articles are unloaded from a trolley 50 at the station 48 and are supplied via chutes 86, 88 and conveyor 90, 92 to a junction with the main path 69 for conveyance to the packing machine 44. The trolley 50 containing rod-like articles may have been previously loaded with articles at the station 48 when supply exceeded demand, or loaded at a different station, which may be in a different conveyor system.

Figure 4:
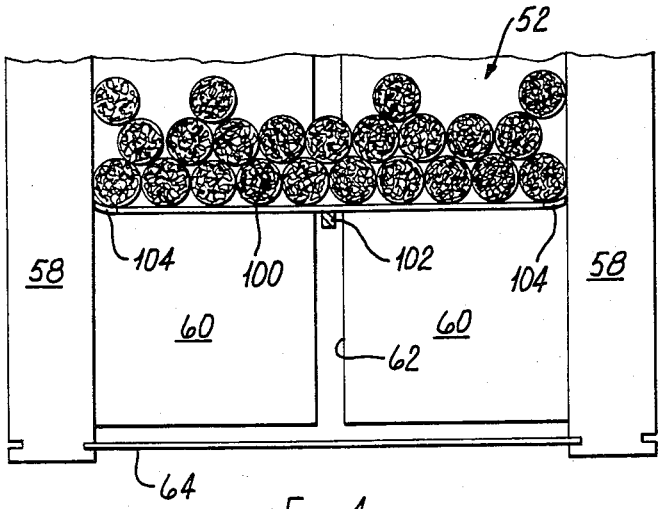
FIG. 4 is a further enlarged view of part of the system shown in FIG. 2.

When the conveyor system 40 is operating to load a trolley 50 with rod-like articles the channels 52, 54 are filled in pairs, together. The filling of each channel 52, 54 is the same, the channel 52 being filled from the outlet 76 and the channel 54 from the outlet 78. The filling of a channel 52 will be described. Just before filling starts the closure 80 is in its closed position so that a stack of articles is held in the chute 72 above the outlet 76. An article lowering plate 100 (FIG. 4) attached to an arm 102 which is connected to drive means within theloading/unloading station 48 is inserted just above the tops of the transparent panels 60 by outward movement of the arm 102, in a direction parallel to the articles, to lie just below the closure 80 at the top of the channel 52. Subsequently the closure 80 is opened and the articles in chute 72 are then supported on the platform 100. The drive means within the station 48 lowers the arm 102, and with it the platform 100, to allow the articles to progressively fill the channel 52. As the platform 100 is lowered flexible ends 104 wipe along the partitions 58. At the bottom of the channel 52 the platform 100 and arm 102 are withdrawn between the bottoms of the panels 60 and the slat 64, the articles in the channel 52 thereafter being supported on this slat.

Shortly before the platform 100 reaches the position at the bottom of the channel 52 and whilst it is still moving downwards the closure 80 for the outlet 76 is actuated to return to its closed position. Movement of the closure 80 to this position is thereby facilitated since the articles in the channel 52 are still moving downwards so that a partial void or at least loosening of the articles occurs to allow the closure to enter the stack. After the platform 100 and arm 102 have been withdrawn they are moved rapidly upwards by the drive means for reinsertion beneath the outlet 76. At the same time the trolley 50 is indexed one pitch to move the next empty channel 52 (and 54) into position for filling. A suitable trolley moving and indexing arrangement is described in British Patent Specification No. 1,117,236.

The downward movement of the platform 100 and arm 102 is at a controlled speed which depends on the rate of supply of articles into the chute 68. The withdrawal, upward return, and reinsertion of the platform 100 is preferably as rapid as possible. The required movement of the platform 100 can be obtained by means of a pair of parallel drive chains following a rectangular path and connected by a link attached to the arm 102. For example, the arrangement may be somewhat similar to that for moving the arm 52 in British Patent Specification No. 1,532,422 or the pusher 46 in British Patent Specification No. 1,547,809. Another possible arrangement including a reciprocating drive member and cam means for projecting and retracting a feed member movable with the drive member is disclosed in connection with FIGS. 9 to 11 of British Patent Specification No. 1,547,809. Alternatively the required movement could be achieved by pneumatic or hydraulic piston and cylinder assemblies acting at right angles.

Accurate registration between the station 48, which includes outlets 76, 78, platform 100, and inlets 82, 84, and the trolley 50 is important. For this reason the trolley 50 is provided with a guide rail 96 which is guided between rollers 98 at the station 48 to centralise the trolley. Some tolerance in the longitudinal positioning of the trolley is provided by the flexible ends 104 of the platform 100, although the arm 102 must pass through the slot 62 which is preferably of lesser width than an article diameter. It is possible to provide additional tolerance for slight longitudinal misalignment of a trolley by arranging for the outlets 76, 78, channels 52, 54 and inlets 82, 84 to be of slightly increasing width. Thus the width of the outlets 76, 78 (as viewed in FIG. 3) may be 95 mm, that of the channels 52, 54, 100 mm and that of the inlets 82, 84, 105 mm.

When it is required to unload articles from a trolley 50 the latter is moved until a pair of channels 52, 54 containing articles is positioned over the inlets 82, 84. The closures 80 for the outlets 76, 78 remain closed. The combined loading/unloading station 48 contains gripping fingers 106 which are actuable to engage and remove the slats 64 by movement in a direction parallel to the articles in the channels 52, 54, as indicated in FIG. 3. On withdrawal of the slats 64 the articles in the channels 52, 54 fall a small distance onto articles already in the chutes 86, 88 just below the inlets 82, 84. The chutes 86, 88 twist the articles so that they are orientated in the same way as in the main path 69 and lead to a combined stack on the conveyor 92. This conveyor 92 returns articles to the main path 69. The short conveyor 90 feeds articles from the chute 86 onto the conveyor 92. Preferably the conveyor 90 is controlled by the level of articles in the chute 88, being switched on and off by a photosensor in this chute, for example.

When the channels 52, 54 are empty, as determined by photosensors at the inlets 82, 84 for example, the slats 64 are returned by the fingers 106. The level of articles in the channels 52, 54 could be sensed by means of a movable sensor plate similar to that disclosed in British Patent Specification No. 1,339,887. A modified platform 100 used for loading of the chutes 52, 54 could possibly also be used as a sensor plate for use during unloading.

The conveyor system 40 may be controlled by reference to the reversible reservoir 46. This may have a neutral or median position at about half maximum capacity and the system 40 may be controlled to keep or tend to keep the reservoir at this position as far as possible. Thus, if the reservoir 46 reaches a high limit switch which is positioned near full capacity (but allowing some safety margin) loading at the station 48 will be initiated and will continue until the reservoir 46 returns to its neutral position. Similarly if the reservoir 46 reaches a low limit switch near its minimum capacity unloading at the station 48 will be initiated and will continue until the reservoir is returned to neutral. The loading and unloading cycles at the station 48 may in addition or independently be controlled in response to stoppage of the packing machine 44 and producing machine 42 respectively.

As indicated in FIG. 2 trolleys 50 are moved in substantial abutment through the loading/unloading station 48. The end partitions 58 of each trolley 50 are half the width of the intermediate partitions, so that the channels 52, 54 are equally spaced in an abutting line of trolleys. The movement of the trolleys 50 through the station 48 is reversible so that channels 52, 54 can be loaded during movement in one direction and unloaded during movement in the opposite direction. Reversal between loading and unloading can take place within the same trolley 50 but once loading or unloading of a pair of channels 52, 54 has commenced this is completed. The trolleys 50 may be moved by indexing means, as previously indicated. Alternatively the trolley 59 could be self-powered.

Typically each trolley 50 may be about 1800 mm long and 900 mm high. This gives a capacity, with rod-like articles of about 8 mm diameter, such as cigarettes or cigarette filter rods, of about 1500 articles per channel 52, 54, or 45000 per trolley 50.

When the rod-like articles conveyed within the system 40 are filter cigarettes the latter are preferably loaded into the trolley channels 52, 54 with the filter tip ends of the cigarettes adjacent the central plate 56. Since there is a tendency for such cigarettes to maintain a slightly higher average diameter at their filter tip ends than at the tobacco ends it may be preferable to provide some tip compensation in the channels 52, 54 by making the partitions 58 slightly wider at their outer ends than at the ends attached to the plate 56, so that the width of a channel reduces slightly away from the plate.

Figure 5:
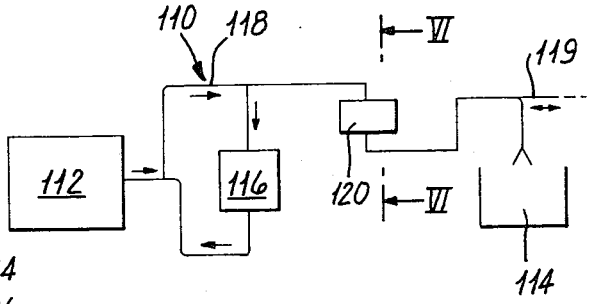
FIG. 5 shows another conveyor system for rod-like articles.
Figure 6:
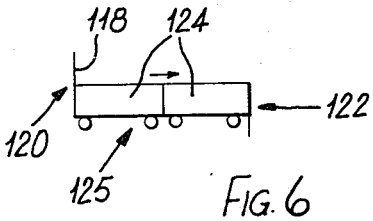
FIG. 6 is a sectional view on the line VI—VI in FIG. 5.

Another conveyor system 110, particularly for linking a machine 112 for producing filter rod-lengths to a pneumatic distribution unit 114, such as Molins APHIS, is shown in FIGS. 5 and 6. In the system 110 a loading-/unloading station 116, basically similar to the station 48 is provided as before. In addition, however, the main path 118 of the system 110 is provided with spaced loading and unloading stations 120, 122, respectively, for trolleys 124. A reversible reservoir 119, such as Molins MOLAR or OSCAR is connected to the path 118. The loading and unloading stations 120, 122 are similar to the respective parts of the combined loading station 48 but are spaced apart so that there is a trolley path 125 between them. The trolleys 124, which may be identical to the trolleys 50, are filled and unloaded in the same way as the trolleys 50. The difference in this part of the system 110 is that all the articles passing along the main path 118 are first loaded into a trolley 124 at the loading station 120 and then unloaded at the unloading station 122 after passing along the path 125, and that the trolleys 124 run only in one direction. The passage of each article from the machine 112 to the unit 114 is therefore delayed, since the movement along the path 125 of the trolleys 124 each of which may hold about 45000 articles, is relatively slow. The trolley path 125 therefore constitutes a delay line in the path 118. In the system 110, for example, the delay line comprises about two complete trolleys 124 and therefore holds about 90,000 articles. As is well known, the use of such a delay line in a system for transporting filter rod lengths from a producing machine 112 is to provide the curing time necessary for certain types of such rod lengths.

The delay line itself could perform the function of the reservoir for the system 110, if required, making the station 116 and its associated by-pass unnecessary. It would then be necessary to move the trolleys 124 in reversible directions between the stations 120 and 122. One possible disadvantage would be that when the unit 114 has re-started after a temporary shut-down a partly-filled trolley 124 would probably remain to the right of the station 122.

Figure 7:
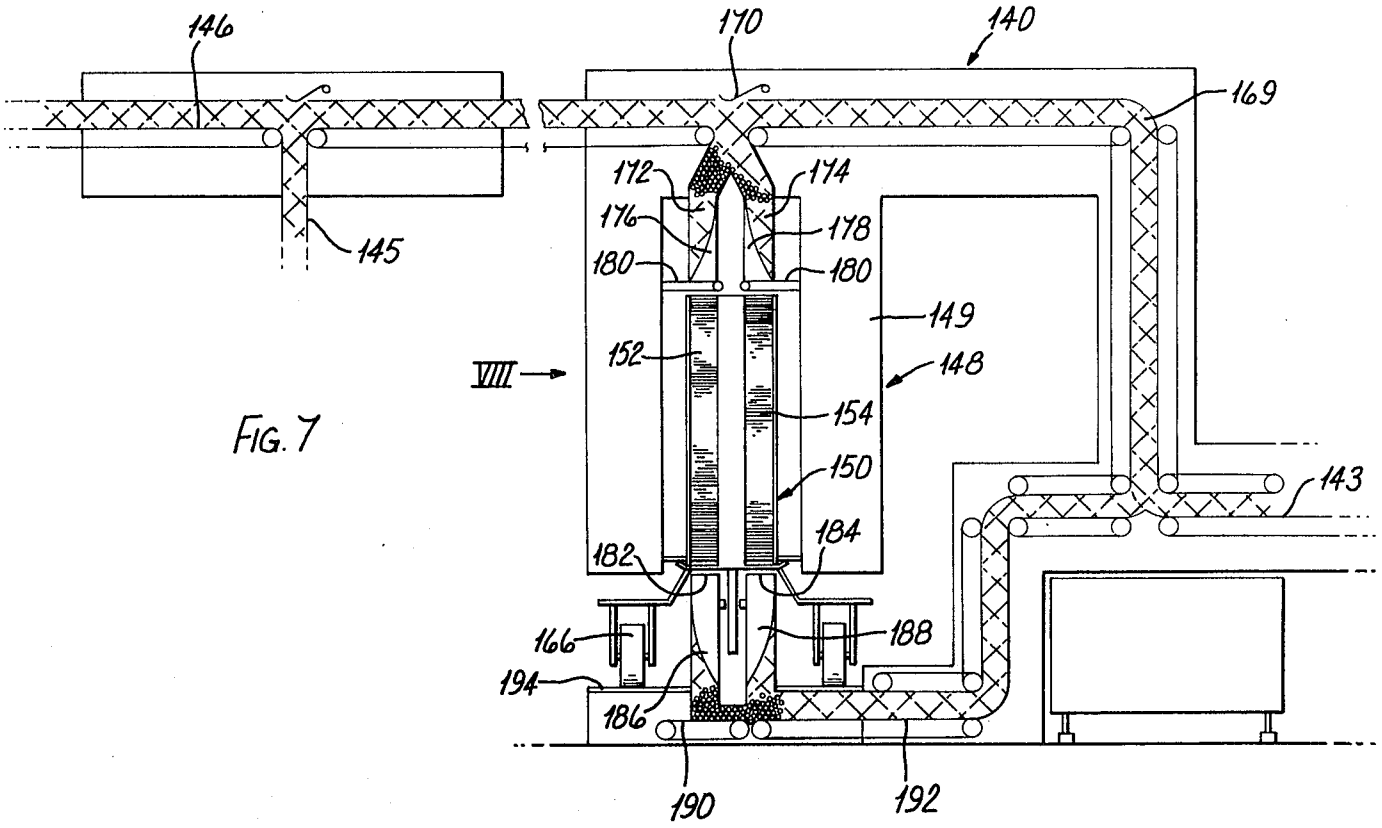
FIG. 7 is a side view of a further conveyor system for rod-like articles.
Figure 8:
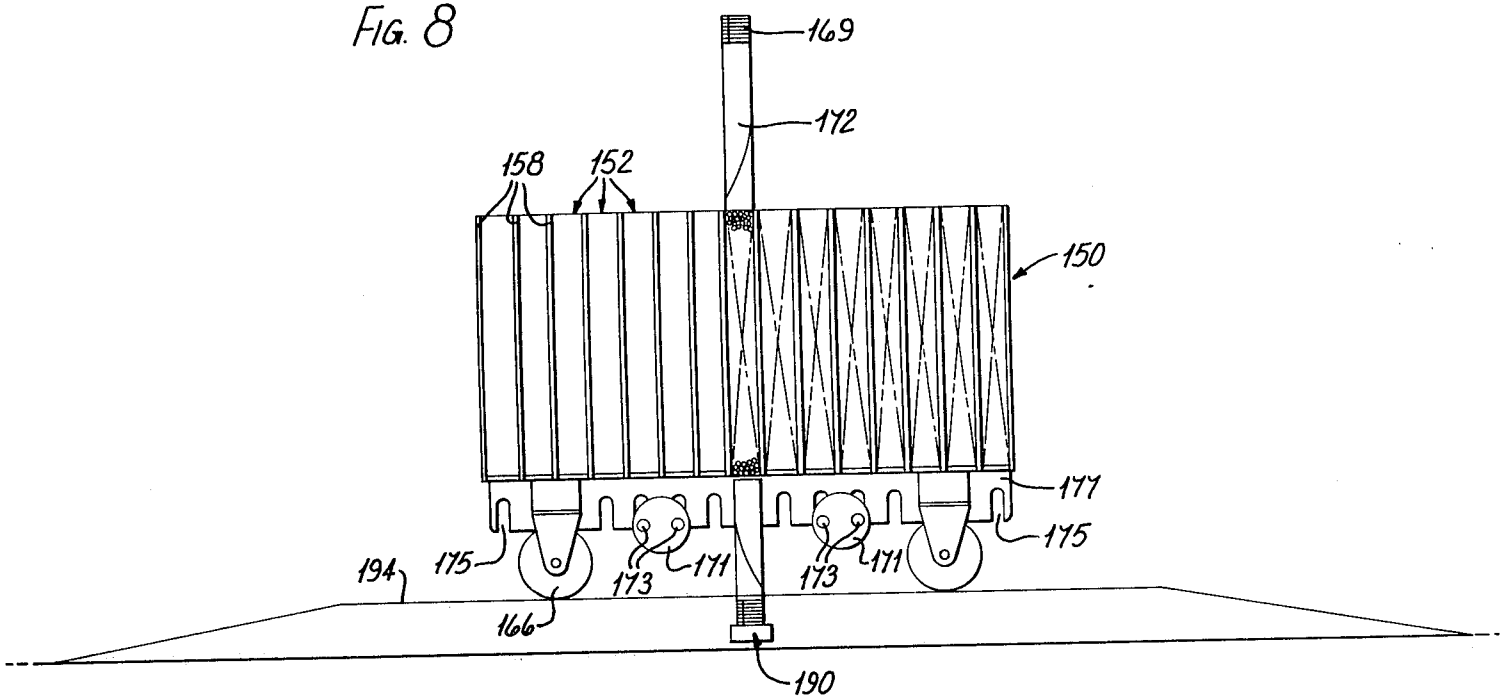
FIG. 8 is a view looking in the direction of arrow VIII in FIG. 7.

FIGS. 7 and 8 show a system 140 which is very similar to that of FIGS. 1 to 4; parts which are similar are referenced by the numbers of the corresponding parts in the system of FIGS. 1 to 4 increased by 100. In the following description only additional points and points of difference will be described.

The main path 169 links a stack conveyor 143 which receives rod-like articles from an article producing machine to a chute 145 which leads to an article packing machine. The various drive means at the loading/unloading station 148 are contained within a housing 149 which forms a tunnel through which the trolley 150 is moved. As shown in FIG. 8, the trolley 150 is indexed by a pair of rotary drive members 171 each of which carries projecting pegs 173 which are engaged in slots 175 in a depending rail 177 attached to each trolley 150. The arrangement is basically similar to that disclosed in British Patent Specification No. 1,117,236.

Figure 9:
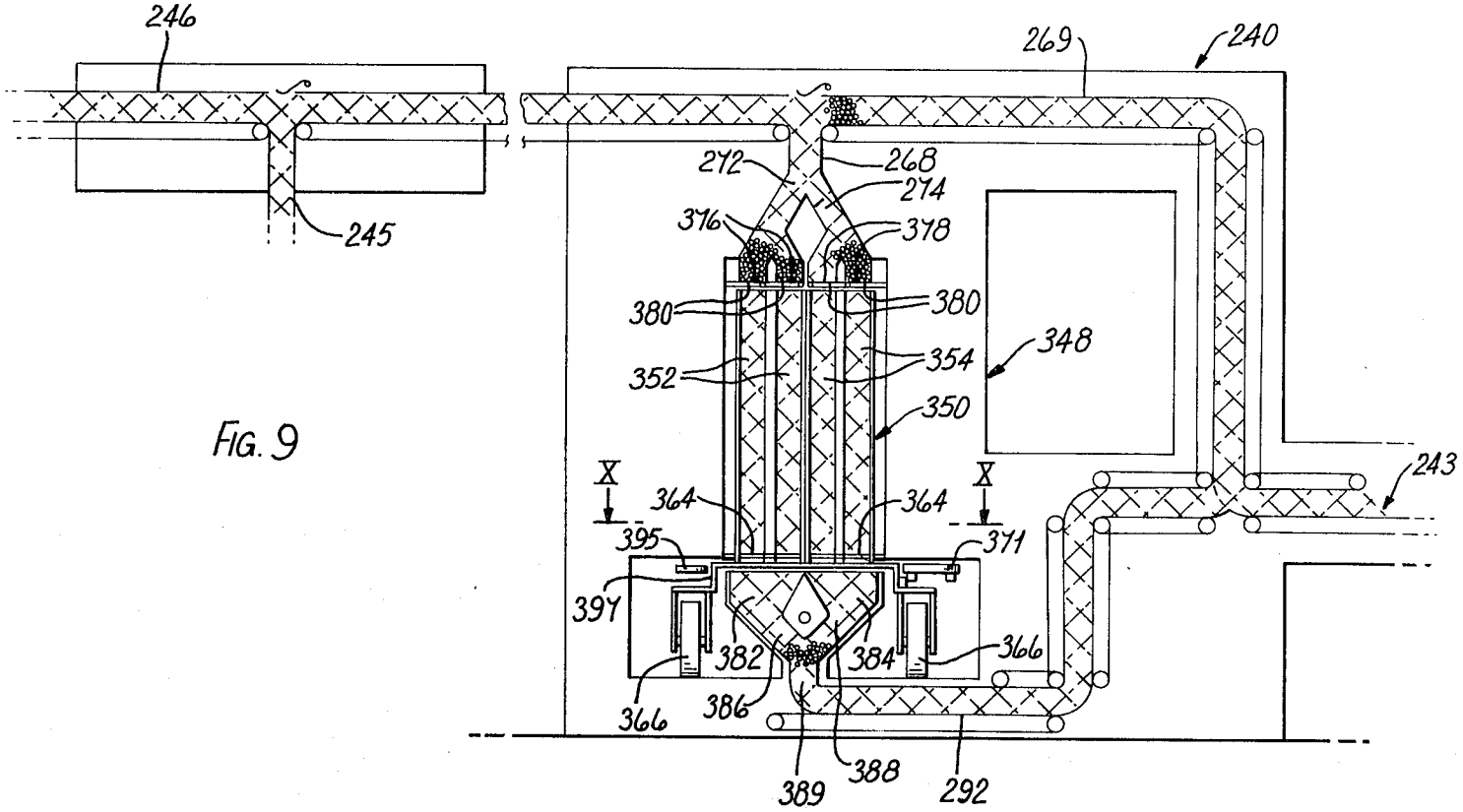
FIG. 9 is a side view of a still further conveyor system for rod-like articles.
Figure 10:
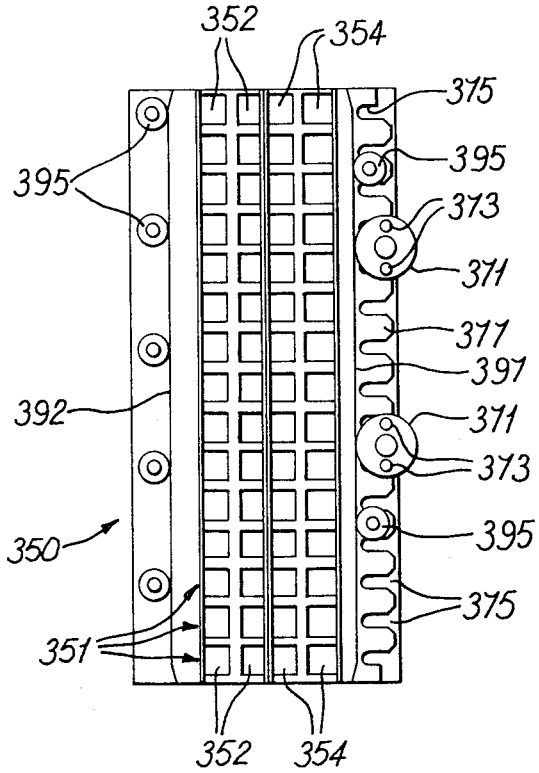
FIG. 10 is a sectional view on the line X—X of FIG. 8.

FIGS. 9 and 10 show a further conveyor system 240 for use with modified trolleys 350. The system 240 is generally similar to the systems 40 and 140 of FIGS. 1 to 4 and FIGS. 7 and 8 respectively; parts which are similar are referenced by the numbers of corresponding parts in the systems 40 and 140 increased by 200 and 100 respectively. Only additional points and points of difference will be described below.

Each trolley 350 has fifteen rows 351 each of four vertical channels 352, 354. The station 348 is adapted to load or unload all the channels 352, 354 of a row 351 at the same time. The chute 268 branches once into chutes 272 and 274 each of which branches again into pairs of outlets 376 and 378 respectively. Each outlet 376, 378 is provided with closure means 380 operable to close the outlets together. Combined inlets 382 and 384 receive the articles from the channels 352, 354, respectively and lead to a combined chute 389 and conveyor 292. The bottoms of the channels 352, 354 are closable by slats 364.

One important difference in the system 240 which should be noted is that the articles do not have to pass through a twisted chute in order to enter the trolley 350 and, correspondingly, they are not twisted before return to the conveyor 292. This is possible since the articles are stored in the channels 352, 354 parallel to the direction of movement of the trolley 350. This has the further advantage that withdrawal of the slats 364 is transverse to the articles in the channels 352, 354. Also, the platform corresponding to the platform 100, for supporting a descending stack of articles in the channels 352 or 354, need not extend for the full width of the channel since it need only support the bottom row of articles at appropriately spaced locations relative to the article length.

Movement of the trolleys 350 is basically as before except that the spaced rotatable drive members 371 are rotatable about vertical axes and carry pegs 373 which engage in slots 375 formed in a horizontally extending channel 377 attached to the trolley 350. The trolley 350 is guided by means of stationary rollers 395 which engage a vertical panel 397 just above the trolley wheels 366.

Apart from advantages which arise as a consequence of storing the articles parallel to the direction of movement of the trolley 350, a further significant advantage is that the trolley 350 can hold twice as many articles as a trolley 50 or 150 without significantly increasing problems of storage and conveyance of the trolley itself.

We claim:

1. A conveyor system for rod-like articles including a delivery station for supplying articles, a receiving station for receiving articles, first and second conveyor means for moving said articles in continuous stack formation in a direction transverse to their lengths from said delivery station to said receiving station, said first conveyor means defining a first path which extends from said delivery station to said receiving station, said second conveyor means defining a second path between spaced junctions in said first path and including a discontinuity located between at least one outlet and at least one inlet, said outlet and inlet being spaced apart along said second path with said inlet being connected to the junction closest to said delivery station for returning articles to said first path at an upstream location with respect to the other junction and said outlet being connected to said other junction which is closest to said receiving station, movable reservoir means having a plurality of compartments, each compartment having an entrance and an exit for articles, means defining a path for said reservoir means whereby the reservoir means may be positioned on said path with an entrance of a compartment and an exit of a compartment simultaneously in position for transfer of articles from said outlet to said inlet, respectively, so that the discontinuity in said second path may be bridged by articles passing through a compartment of said reservoir means, and control means for said first and second conveyor means for maintaining a substantially-continuous stack of said articles on said first path between said delivery station and said receiving station, for advancing a substantially-continuous stack from one of said junctions along said second path and into a compartment through said outlet, and for advancing a substantially-continuous stack from a compartment through said inlet and along said second path to the other of said junctions.

2. A conveyor system as claimed in claim 1, wherein said movable reservoir means is constructed so that a compartment may be brought into simultaneous registration with said outlet and said inlet.

3. A conveyor system as claimed in claim 1, wherein the exit of each compartment is constructed so that it may be brought into registration with an inlet to supply articles directly to said second conveyor means through said inlet.

4. A conveyor system as claimed in claim 1, wherein said compartments and said outlet and inlet are arranged so that compartments may be loaded and unloaded by articles moving under action of gravity.

5. A conveyor system as claimed in claim 4, wherein said compartments comprise substantially vertical channels.

6. A conveyor system as claimed in claim 1, including removable closure means for said outlet.

7. A conveyor system as claimed in claim 6, wherein said removable closure means comprises a movable band assembly which may be projected across said outlet.

8. A conveyor system as claimed in claim 1, including means adjacent said outlet and movable in a compartment being loaded from said outlet for bounding the leading articles advancing into the compartment.

9. A conveyor system as claimed in claim 8, wherein said movable means for bounding the leading articles comprises a platform movable into the compartment in a direction transverse to the lengths of the articles, movable through the compartment, and movable out of the compartment in a direction transverse to the lengths of the articles.

10. A conveyor system as claimed in claim 1, wherein each compartment has removable closure means associated with its exit.

11. A conveyor system as claimed in claim 10, including means adjacent said inlet for removing the exit closure means of a compartment prior to unloading and for replacing it after unloading of the compartment.

12. A conveyor system as claimed in claim 1, including drive means for moving the reservoir means intermittently along said path.

13. A conveyor system as claimed in claim 12, wherein the reservoir means includes at least one trolley.

14. A conveyor system as claimed in claim 1, wherein articles in said compartments are moved along said path in said compartments in a direction parallel to their lengths.

15. A conveyor system as claimed in claim 1, wherein the reservoir means has two or more parallel sets of compartments.

16. A conveyor system as claimed in claim 15, wherein the first conveyor means is provided with appropriately spaced outlets and the second conveyor means with appropriately spaced inlets, whereby compartments from different sets in said reservoir means may be simultaneously loaded or unloaded.

17. A conveyor system as claimed in claim 15 or claim 16, including an inlet adapted to receive articles from the exits of compartments in different sets.

18. A conveyor system as claimed in claim 1, including at least one sensor for determining conditions in said first conveyor means, and means for initiating loading or unloading of a compartment in response to a signal from said sensor.

19. A conveyor system as claimed in claim 18, wherein said first conveyor means includes reversible reservoir means and said sensor is arranged to detect the state of fill of said reversible reservoir.

20. A conveyor system as claimed in claim 1, wherein said outlet and said inlet are spaced with respect to said path and wherein articles moving from a first station supplying articles to said first conveyor means to a second station supplied with articles from said second conveyor means are conveyed along said path in said compartment.

21. A conveyor system for rod-like articles including a delivery station, a receiving station, first conveyor means for moving said articles in continuous stack formation and defining a first path extending from the delivery station to an outlet and a second path extending from an inlet to the receiving station, said outlet and said inlet being horizontally spaced apart, second conveyor means defining an intermediate path for articles between said outlet and said inlet, said second conveyor means comprising movable reservoir means having a plurality of compartments, each compartment having an entrance and an exit for articles, means defining a reservoir path for said reservoir means whereby the reservoir means may be positioned at one end of said reservoir path with an entrance of a compartment in position for transfer of articles from said outlet to said compartment through said entrance and movable to the other end of said reservoir path with an exit of a compartment in position for transfer of articles from said compartment to said inlet through said exit, and means for operating said first and second conveyor means to maintain substantially-continuous streams of articles in stack formation in said first and second paths extending respectively from said delivery station to said outlet and from said inlet to said receiving station and to maintain a relatively-slow moving substantial store of articles in stack formation in said intermediate path.

22. A conveyor system as claimed in claim 1, wherein the reservoir means has two or more parallel sets of compartments, the second conveyor means being provided with appropriately-spaced outlets whereby compartments from different sets in said reservoir means may be simultaneously loaded.

23. A conveyor system as claimed in claim 22, including an inlet adapted to receive articles from the exits of compartments in different sets.

* * * * *